US011371311B2

(12) United States Patent
Vasques

(10) Patent No.: US 11,371,311 B2
(45) Date of Patent: Jun. 28, 2022

(54) ANNULAR BARRIER WITH PRESS CONNECTIONS

(71) Applicant: WELLTEC OILFIELD SOLUTIONS AG, Zug (CH)

(72) Inventor: Ricardo Reves Vasques, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 0 days.

(21) Appl. No.: 16/910,549

(22) Filed: Jun. 24, 2020

(65) Prior Publication Data

US 2020/0408061 A1 Dec. 31, 2020

(30) Foreign Application Priority Data

Jun. 25, 2019 (EP) ..... 19182251

(51) Int. Cl.
*E21B 33/127* (2006.01)
*E21B 43/10* (2006.01)

(52) U.S. Cl.
CPC ..... *E21B 33/1277* (2013.01); *E21B 43/105* (2013.01); *E21B 43/106* (2013.01)

(58) Field of Classification Search
CPC .. E21B 33/1277; E21B 43/105; E21B 33/127; E21B 19/16; E21B 33/1212; E21B 43/106
USPC ..... 166/187
See application file for complete search history.

(56) References Cited

U.S. PATENT DOCUMENTS

| | | | | |
|---|---|---|---|---|
| 4,319,393 | A | 3/1982 | Pogonowski | |
| 6,640,893 | B1 | 11/2003 | Rummel et al. | |
| 10,385,993 | B2 * | 8/2019 | Stewart | F16L 13/142 |
| 2014/0000911 | A1 | 1/2014 | Gorrara et al. | |
| 2016/0047178 | A1 * | 2/2016 | Thomson | E21B 17/04 166/380 |
| 2016/0084410 | A1 * | 3/2016 | Stewart | F16L 13/142 285/382.2 |
| 2016/0273298 | A1 * | 9/2016 | Vasques | E21B 33/1208 |

FOREIGN PATENT DOCUMENTS

GB 2501988 11/2013

OTHER PUBLICATIONS

Extended Search Report for EP19182251.9 dated Dec. 17, 2019, 6 pages.

* cited by examiner

*Primary Examiner* — Giovanna Wright
(74) *Attorney, Agent, or Firm* — Nixon & Vanderhye P.C.

(57) ABSTRACT

An annular barrier for providing zonal includes a tubular metal part, and an expandable metal sleeve surrounding the tubular metal part. The expandable metal sleeve has a first end part, a second end part and an outer face, and at least one of the end parts includes at least one circumferential groove facing the outer part face, wherein the tubular metal part bulges radially outwards in relation to the axial extension, forming at least one circumferential projection engaging the groove, thus providing a connection of the expandable metal sleeve to the tubular metal part.

18 Claims, 5 Drawing Sheets

ANNULAR BARRIER WITH PRESS CONNECTIONS

CROSS REFERENCE TO RELATED APPLICATION

This application claims priority to EP Patent Application No. 19182251.9 filed 25 Jun. 2019, the entire contents of which is hereby incorporated by reference.

BACKGROUND

The present invention relates to an annular barrier for providing zonal isolation in an annulus downhole between a well tubular metal structure and another well tubular metal structure or a wall of a borehole, the annular barrier having an axial extension. The invention also relates to a downhole system and a mounting method for mounting an expandable metal sleeve of an annular barrier to the tubular metal part.

BRIEF SUMMARY

Annular barriers are mounted as part of a cased well with the aim of isolating a production zone from other zones which are producing an excessive amount of water. Some of these barriers have an expandable metal sleeve which is fastened to the well tubular metal structure by means of welding or crimping. However, sometimes such fastening is not successful, for example in wells having a very varying hole diameter, such as washouts, where the expandable metal sleeve may have to be expanded to a larger extent than such connections are able to withstand without jeopardising the sealing ability of the annular barrier.

Furthermore, fastening the expandable metal sleeve by means of welding or crimping is time-consuming, not easily done and almost impossible to do on site.

It is an object of the present invention to wholly or partly overcome the above disadvantages and drawbacks of prior art. More specifically, it is an object to provide an improved annular barrier which is easier to mount to the well tubular metal structure and/or which is capable of withstanding a high level of expansion without jeopardising the sealing ability of the annular barrier, especially at the connection of the expandable metal sleeve to the well tubular metal structure.

The above objects, together with numerous other objects, advantages and features which will become evident from the below description, are accomplished by a solution in accordance with the present invention by an annular barrier for providing zonal isolation in an annulus downhole between a well tubular metal structure and another well tubular metal structure or a wall of a borehole, the annular barrier having an axial extension and comprising:

- a tubular metal part with an inner part face and an outer part face and configured to be mounted as part of the well tubular metal structure,
- an expandable metal sleeve surrounding the tubular metal part, forming an expandable space between the tubular metal part and the expandable metal sleeve; the expandable metal sleeve is configured to be expanded in a well downhole from a first outer diameter to a second outer diameter in order to abut against the well tubular metal structure or the wall of the borehole, the expandable metal sleeve having a first end part, a second end part and an outer face, and at least the first end part comprising one or more circumferential grooves facing the outer part face, wherein the tubular metal part bulges radially outwards in relation to the axial extension, forming at least one circumferential projection engaging the groove, thus providing a connection of the expandable metal sleeve to the tubular metal part.

In one aspect, the second end part is slidably connected with the tubular metal part.

In another aspect, the second end part is fixedly connected with the tubular metal part by means of a bite connection.

In yet another aspect, the second end part is fixedly connected with the tubular metal part by welding, crimping or a similar connection method.

In addition, the projection may have a projection height which varies along the circumference of the tubular metal part.

Moreover, the projection may have a round cross-sectional shape at least along the axial extension.

Furthermore, the projection may be provided by means of an expander tool.

Also, the tubular metal part may comprise an indentation in the inner part face opposite the projection.

Additionally, the annular barrier may comprise a sealing element arranged in the groove.

Further, the expandable metal sleeve may comprise several grooves, and the tubular metal part may comprise a corresponding number of projections.

Moreover, one of the grooves may be fluidly connected with a channel for the measurement of pressure as the tubular metal part bulges into the groove.

In addition, the connection between the expandable metal sleeve and the tubular metal part may be verified during mounting of the expandable metal sleeve to the tubular metal part.

Furthermore, the tubular metal part may comprise an expansion opening for allowing fluid to enter in order to expand the expandable metal sleeve.

Also, the annular barrier may comprise a valve arranged in the expansion opening or at least in fluid communication with the expansion opening for controlling the flow of fluid from within the tubular metal part/well tubular metal structure to the expandable space.

Additionally, each end part of the expandable metal sleeve may comprise grooves, the tubular metal part comprising a corresponding number of projections, and each projection engaging one of the grooves.

Further, the expandable metal sleeve may have an intermediate part between the end parts, the intermediate part having a smaller thickness than that of the end parts.

Moreover, the tubular metal part may have a first thickness and a second thickness at the projection, which second thickness may be substantially the same as the first thickness.

In addition, the second thickness may be substantially uniform at the projection since some thinning occurs during the bulging of the tubular metal part.

Furthermore, the present invention relates to a downhole system comprising the annular barrier and a well tubular metal structure, where the tubular metal part of the annular barrier is mounted as part of the well tubular metal structure.

The present invention also relates to a mounting method for mounting an expandable metal sleeve of an annular barrier to the tubular metal part, comprising:

- positioning the expandable metal sleeve around the tubular metal part,
- positioning the expander tool inside the tubular metal part opposite the groove of the expandable metal sleeve, expanding the expander tool radially outwards until the tubular metal part bulges into the groove, forming a projection engaging the groove and fastening the expandable metal sleeve to the tubular metal part.

Finally, the expander tool may expand radially outwards until a sealing element in the groove is compressed.

BRIEF DESCRIPTION OF THE DRAWINGS

The invention and its many advantages will be described in more detail below with reference to the accompanying schematic drawings, which for the purpose of illustration show some non-limiting embodiments and in which.

DETAILED DESCRIPTION

All the figures are highly schematic and not necessarily to scale, and they show only those parts which are necessary in order to elucidate the invention, other parts being omitted or merely suggested.

Figure 1:
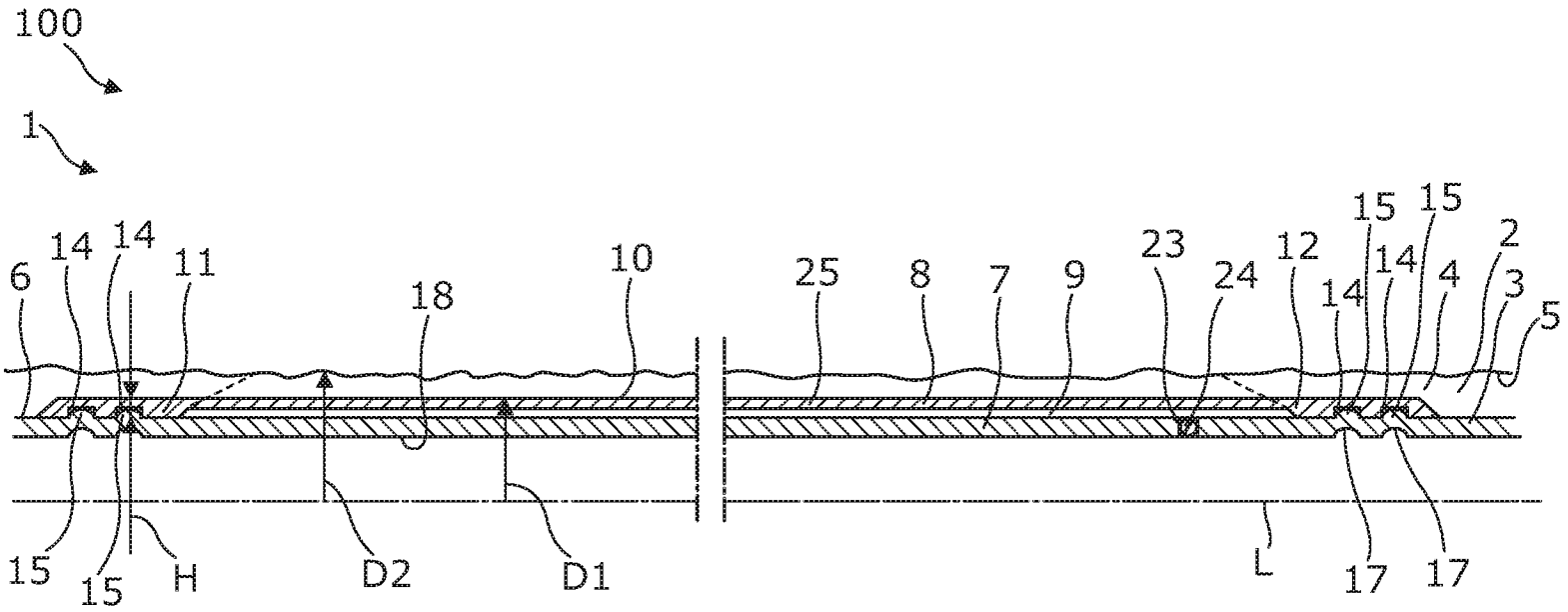
FIG. 1 shows a cross-sectional view of an annular barrier having grooves and engaging bulged projections.
Figure 2:
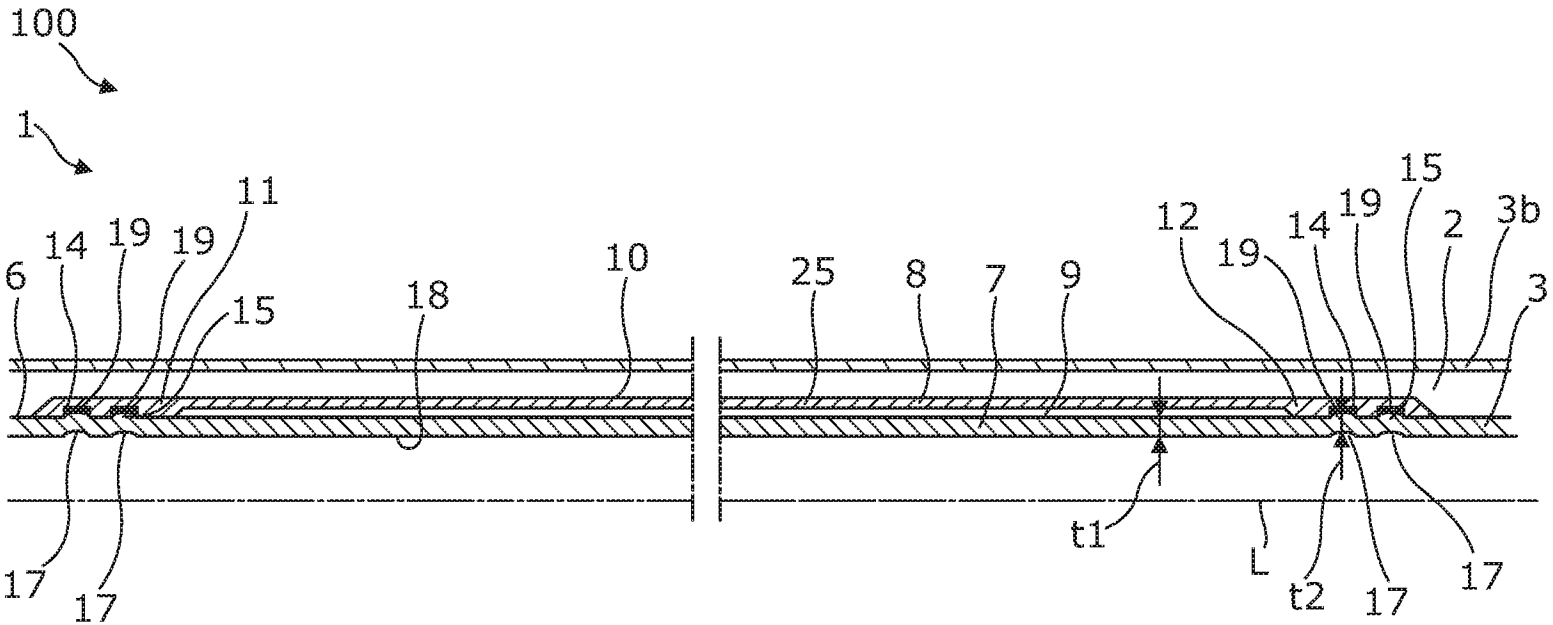
FIG. 2 shows a cross-sectional view of another annular barrier to be expanded within a well tubular metal structure.

FIG. 1 shows an annular barrier 1 for providing zonal isolation in an annulus 2 downhole between a well tubular metal structure 3 and another well tubular metal structure 3*b* (as shown in FIG. 2) or a wall 5 of a borehole 4. The annular barrier has an axial extension L and comprises a tubular metal part 7 having an inner part face 18 and an outer part face 6. The tubular metal part is mounted as part of the well tubular metal structure 3. The annular barrier further comprises an expandable metal sleeve 8 surrounding the tubular metal part, forming an expandable space 9 between the tubular metal part and the expandable metal sleeve. The expandable metal sleeve 8 is configured to be expanded in a well downhole from a first outer diameter D1 to a second outer diameter D2 in order to abut against the wall of the borehole, as indicated by the dotted line. The expandable metal sleeve 8 has a first end part 11, a second end part 12 and an outer face 10. The end parts comprise two circumferential grooves 14 facing the outer part face, the tubular metal part bulging radially outwards in relation to the axial extension, forming two circumferential projections 15, each engaging one of the grooves and providing a mechanical connection of the expandable metal sleeve to the tubular metal part, i.e. mechanically connecting the expandable metal sleeve and the tubular metal part. The tubular metal part comprises an indentation 17 in the inner part face 18 opposite each projection 15.

The connection between the expandable metal sleeve 8 and the tubular metal part 7 is thus easily made by pressing from within the tubular metal part by means of an expander tool until the tubular metal part forms projections when bulging into the grooves, making indentations on the inner part face 18. Each projection 15 has a round cross-sectional shape at least along the axial extension.

By forcing part of the tubular metal part into grooves of the expandable metal sleeve, the expandable metal sleeve is fastened to the tubular metal part in a simple manner which does not alter the material properties as seen in prior art in relation to welding or crimping. Furthermore, fastening is easier to reproduce than welding. Moreover, such press connection is substantially cheaper to use for mounting of the expandable metal sleeve to the tubular metal part as this solution is less time-consuming than welding.

As shown in FIG. 1, the annular barrier 1 comprises an expansion opening 23 in the tubular metal part for allowing fluid to enter in order to expand the expandable metal sleeve 8. The annular barrier further comprises a valve 24 arranged in the expansion opening or at least in fluid communication with the expansion opening for controlling the flow of fluid from within the tubular metal part/well tubular metal structure to the expandable space. The valve may also be arranged in connection with one of the ends of the expandable metal sleeve, even though not shown.

FIG. 2 shows the annular barrier 1 further comprising a sealing element 19 arranged in each groove so that the sealing elements 19 are squeezed when the projections bulge into the grooves, providing a seal between the expandable metal sleeve and the tubular metal part. The tubular metal part 7 has a first thickness t1 and a second thickness t2 at the projection 15, which second thickness is substantially the same as the first thickness. By "substantially the same" is meant that the second thickness is substantially the same, i.e. a uniform thickness since some thinning occurs during the bulging of the tubular metal part. Each end part 11, 12 of the expandable metal sleeve 8 comprises grooves 14, and the tubular metal part 7 comprises a corresponding number of projections 15, each projection engaging one of the grooves.

The expandable metal sleeve 8 has an intermediate part 25 extending from the first end part to the second end part, i.e. between the end parts, and the intermediate part has a smaller thickness than that of the end parts.

Figure 3:
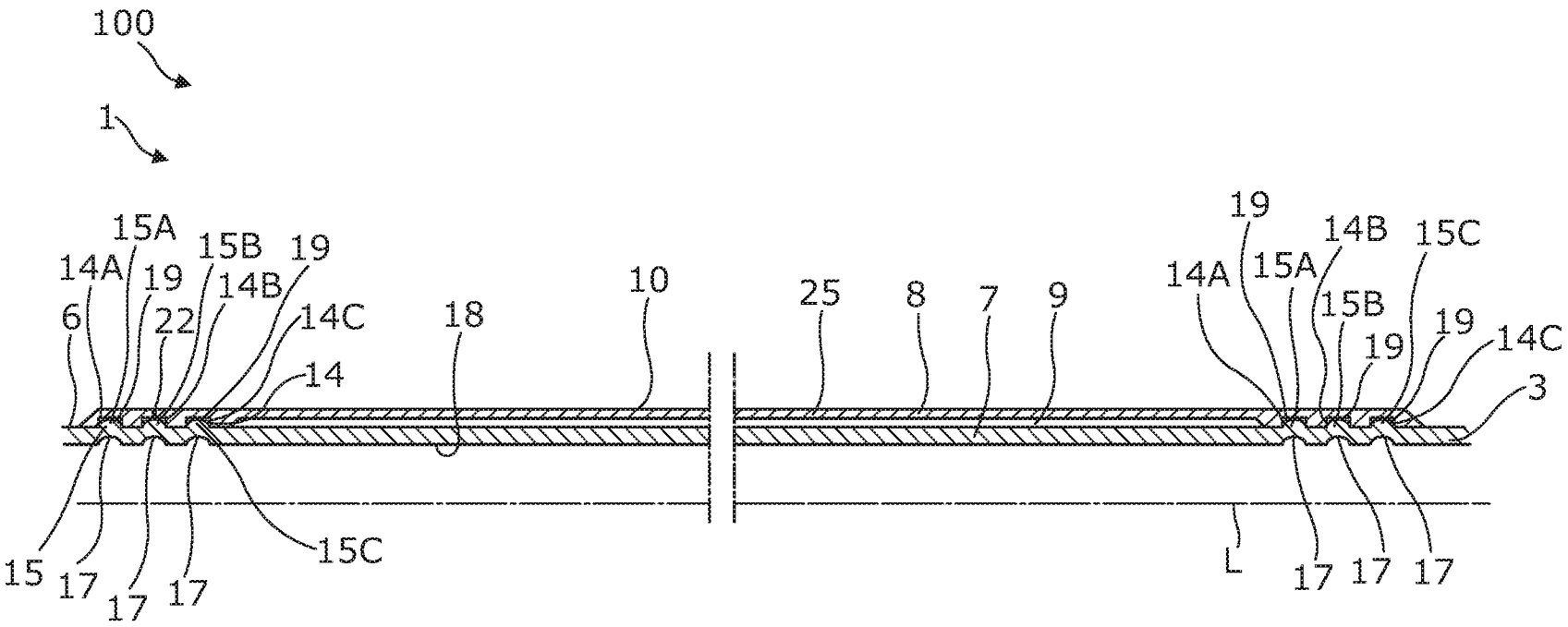
FIG. 3 shows a cross-sectional view of yet another annular barrier having a testing channel.

In FIG. 3, the expandable metal sleeve comprises three grooves 14—14A, 14B and 14C—wherein the tubular metal part comprises a corresponding number of projections 15—15A, 15B and 15C. One of the grooves is fluidly connected with a channel 22 for the measurement of pressure as the tubular metal part bulges into the groove during the mounting of the expandable metal sleeve 8 to the tubular metal part 7. In this way, the connection between the expandable metal sleeve and the tubular metal part can be verified during mounting of the expandable metal sleeve to the tubular metal part, while the two other grooves and projections provide the sealing ability between the expandable metal sleeve and the tubular metal part, as shown in FIG. 4.

Figure 4:
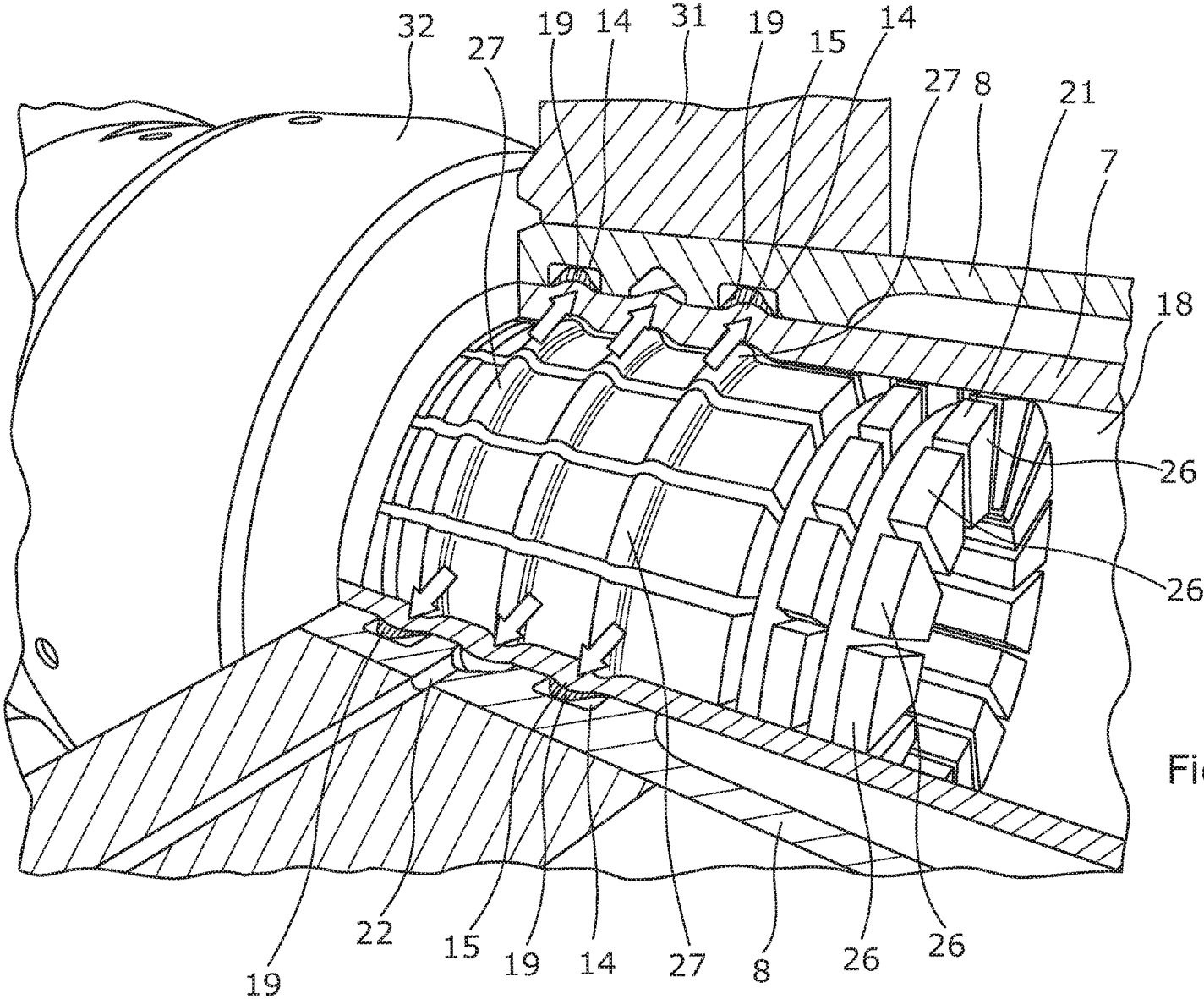
FIG. 4 shows a partial cross-sectional view of an annular barrier during mounting of the expandable metal sleeve to the tubular metal part by means of an expander tool.

As shown in FIG. 4, the projection 15 is provided by means of an expander tool 21, and the projection has a projection height H (shown in FIG. 1) which may vary along the circumference of the tubular metal part 7. The expander tool 21 expands by projecting outwards a plurality of radially moving parts 26 having spikes 27, and when expanding the parts 26, a small gap is formed between two adjacent parts 26, and thus the projection height may slightly vary, corresponding to the small gaps.

Figure 5:
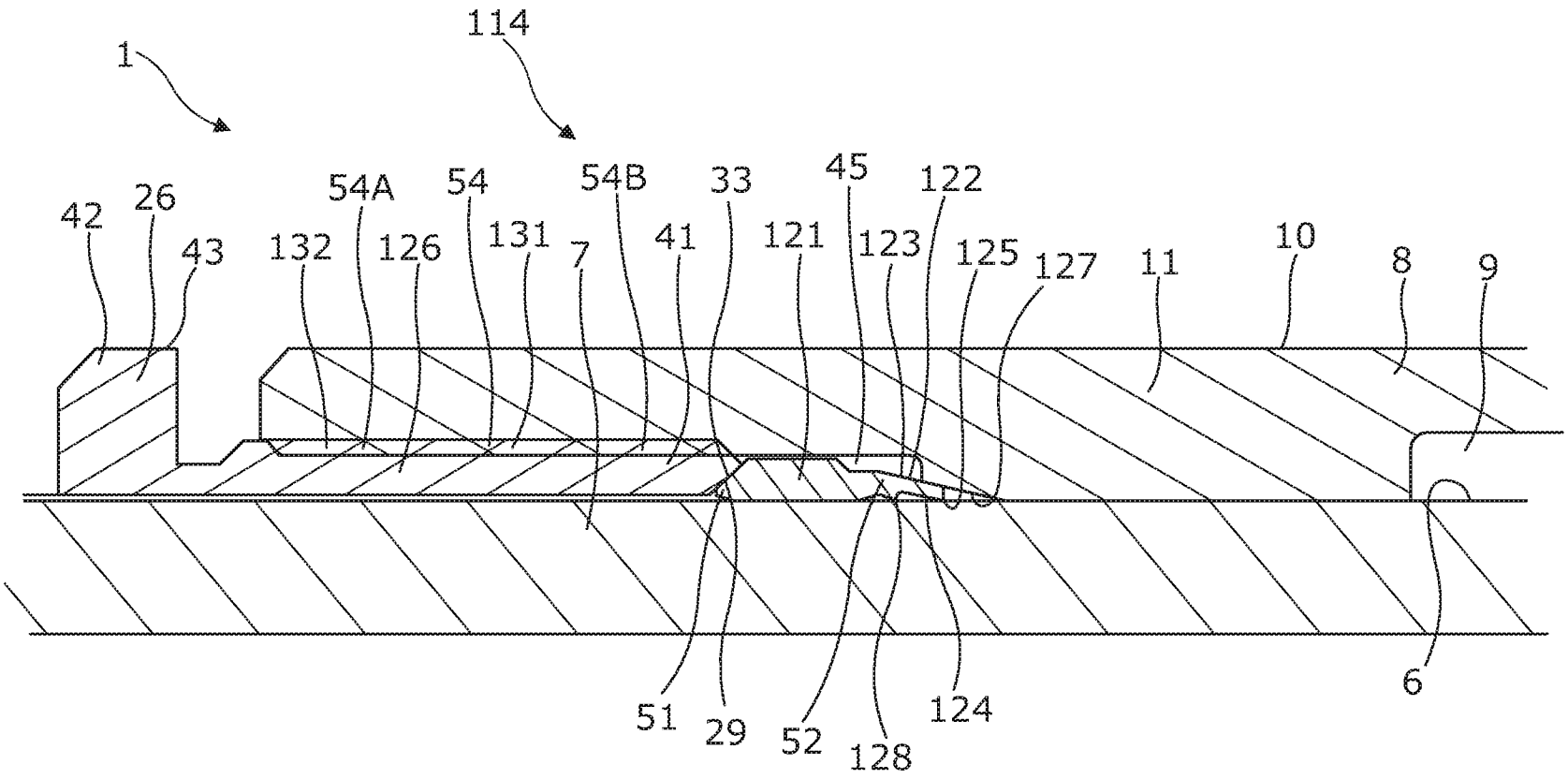
FIG. 5 shows a second end part that is fixedly connected with the tubular metal part by means of a bite connection.

The expandable metal sleeve 8 is fastened in one end by pressing from within the tubular metal part by means of an expander tool until the tubular metal part forms projections when bulging into the grooves, making indentations on the inner part face 18. In the other end, the expandable metal sleeve may be fastened by means of a bite connection as shown in FIG. 5 or another way of fastening, or it may be made as a sliding end, i.e. sliding in relation to the tubular metal part. As shown in FIG. 5, the first end of the expandable metal sleeve has a first part 54A of a mechanical connection 54 being a thread 131. The first end of the expandable metal sleeve is connected to the tubular metal part by means of a bite connection 114. The bite connection 114 comprises a cutting ring 121 comprising an outer ring face 122 having an inclined face 123 and an inner ring face 124 having a first cutting edge 125 configured to cut into the outer part face of the tubular metal part. The bite connection 114 further comprises a connection ring 126 with a second part 54B of the mechanical connection 54 being a thread 132 engaging the thread of the expandable metal sleeve so that when rotating the connection ring, the inclined face 123 slides along a tapering face 127 of the expandable metal sleeve, pressing the first cutting edge into the outer part face and fastening the expandable metal sleeve 8 to the tubular metal part 7. By forcing the cutting ring into the outer part face of the tubular metal part, the expandable metal sleeve is fastened to the tubular metal part in a simple manner which does not alter the material properties as seen in prior art in relation to welding or crimping. Furthermore, fastening is easier to reproduce than welding. Moreover, a bite connection is substantially cheaper to use for mounting of the expandable metal sleeve to the tubular metal part as this solution is less time-consuming than welding. The bite connection fastens the expandable metal sleeve to the tubular metal part using the threaded connection to the expandable metal sleeve and rotating the connection ring so that the bite, i.e. the cutting ring 121, is forced to press and/or cut into the outer part face of the tubular metal part. The bite connection provides a very simple way of mounting the expandable metal sleeve to the tubular metal part, and the connection may be performed on site, i.e. on the rig or platform.

The invention further relates to a downhole system 100 as shown in FIG. 1 which comprises the annular barrier 1 and the well tubular metal structure 3, where the tubular metal part of the annular barrier is mounted as part of the well tubular metal structure.

When mounting the expandable metal sleeve 8 of the annular barrier 1 to the tubular metal part 7, the expandable metal sleeve is first positioned around the tubular metal part in the predetermined position of the annular barrier 1 when positioned in the well. Next, the expander tool 21 is positioned inside the tubular metal part opposite the groove 14 of the expandable metal sleeve, as shown in FIG. 4. In FIG. 4, the tubular metal part and the surrounding expandable metal sleeve are arranged in a fixture 31 of a tool part 32, and the expander tool is expanded by projecting the parts 26 radially outwards until the tubular metal part bulges into the groove, forming a projection engaging the groove and fastening the expandable metal sleeve to the tubular metal part. The expander tool may comprise a plurality of radially moving parts 26 having spikes 27, which are moved radially outwards to expand the outer diameter of the tool, thus pressing the spikes into the tubular metal part, deforming that part of the tubular metal part and forming the projections 15 and indentations 17 so that the tubular metal part is formed with a bulging cross-sectional shape. When the expander tool expands radially outwards, the sealing element in the groove is compressed, resulting in a slightly inherent spring force in the sealing element 19 so that when the pressure is released again, the sealing element decompresses, filling out the small gap between the groove and the projections.

By "fluid" or "well fluid" is meant any kind of fluid that may be present in oil or gas wells downhole, such as natural gas, oil, oil mud, crude oil, water, etc. By "gas" is meant any kind of gas composition present in a well, a completion or an open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

In the event that the tool is not submergible all the way into the casing, a downhole tractor can be used to push the tool all the way into position in the well. The downhole tractor may have projectable arms with wheels that contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. An annular barrier for providing zonal isolation in an annulus downhole between a well tubular metal structure and a further well tubular metal structure or a wall of a borehole, the annular barrier having an axial extension and comprising:

a tubular metal part with an inner part face and an outer part face and configured to be mounted as part of the well tubular metal structure, and an expandable metal sleeve surrounding the tubular metal part, forming an expandable space therebetween; the expandable metal sleeve is configured to be expanded in a well downhole from a first outer diameter to a second outer diameter in order to abut against the further well tubular metal structure or the wall of the borehole which may be variable in diameter, the expandable metal sleeve having a first end part, a second end part and an outer face all made of a homogeneous expandable metal material, and at least one of the first and second end parts comprising at least one circumferential groove facing the outer part face, wherein the tubular metal part bulges radially outwards in relation to the axial extension, forming at least one circumferential projection engaging the circumferential groove, providing a connection of the expandable metal sleeve to the tubular metal part, wherein the tubular metal part comprises an indentation in the inner part face opposite the circumferential projection.

2. An annular barrier according to claim 1, wherein the circumferential projection has a projection height which varies along the circumference of the tubular metal part.

3. An annular barrier according to claim 1, wherein the circumferential projection is provided by means of an expander tool pressing from within the tubular metal part.

4. An annular barrier according to claim 1, further comprising a sealing element arranged in the circumferential groove.

5. An annular barrier according to claim 4, wherein the sealing element comprises a compressible material that compresses when the projection bulges into the circumferential groove, and is expandable to fill a gap between the projection and the groove.

6. An annular barrier according to claim 1, wherein the expandable metal sleeve comprises several circumferential grooves, and wherein the tubular metal part comprises a corresponding number of circumferential projections.

7. An annular barrier according to claim 6, wherein one of the circumferential grooves is fluidly connected with a channel for measurement of pressure as the tubular metal part bulges into the circumferential groove.

8. An annular barrier according to claim 1, wherein the tubular metal part comprises an expansion opening for allowing fluid to enter in order to expand the expandable metal sleeve.

9. An annular barrier according to claim 1, wherein each end part of the expandable metal sleeve comprises circumferential grooves, and the tubular metal part comprises a corresponding number of circumferential projections, each projection engaging one of the circumferential grooves.

10. An annular barrier according to claim 1, wherein the expandable metal sleeve has an intermediate part between the end parts, the intermediate part having a smaller thickness than that of the end parts.

11. An annular barrier according to claim 1, wherein the tubular metal part has a first thickness and a second thickness at the circumferential projection, which second thickness is substantially the same as the first thickness.

12. An annular barrier according to claim 11, wherein the second thickness is substantially uniform since some thinning occurs during the bulging of the tubular metal part.

13. An annular barrier according to claim 1, further comprising a fixture configured to be arranged to surround the expandable metal sleeve and to radially align with the circumferential groove and an expander tool.

14. Downhole system comprising the annular barrier according to claim 1 and the well tubular metal structure, where the tubular metal part of the annular barrier is mounted as part of the well tubular metal structure.

15. A mounting method for mounting to the tubular metal part the expandable metal sleeve of the annular barrier according to claim 1, comprising:

positioning the expandable metal sleeve around the tubular metal part, positioning an expander tool inside the tubular metal part opposite the circumferential groove of the expandable metal sleeve, expanding the expander tool radially outwards until the tubular metal part bulges into the circumferential groove, forming the circumferential projection engaging the circumferential groove and fastening the expandable metal sleeve to the tubular metal part.

16. A mounting method according to claim 15, wherein the expander tool expands radially outwards until a sealing element in the circumferential groove is compressed.

17. A mounting method according to claim 15, wherein a fixture is arranged to surround the expandable metal sleeve and is radially aligned with the circumferential groove and the expander tool.

18. An annular barrier for providing zonal isolation in an annulus downhole between a well tubular metal structure and a further well tubular metal structure or a wall of a borehole, the annular barrier having an axial extension and comprising: —a tubular metal part with an inner part face and an outer part face and configured to be mounted as part of the well tubular metal structure; —an expandable metal sleeve surrounding the tubular metal part, forming an expandable space therebetween, the expandable metal sleeve is configured to be expanded in a well downhole from a first outer diameter to a second outer diameter in order to abut against the further well tubular metal structure or the wall of the borehole which may be variable in diameter, the expandable metal sleeve having a first end part, a second end part and an outer face all made of a homogeneous expandable metal material, and at least one of the first and second end parts comprising at least one circumferential groove facing the outer part face, wherein the tubular metal part bulges radially outwards in relation to the axial extension, forming at least one circumferential projection engaging the circumferential groove, providing a connection of the expandable metal sleeve to the tubular metal part; and a fixture configured to be arranged to surround the expandable metal sleeve and to radially align with the circumferential groove and an expander tool.

* * * * *